United States Patent [19]

Schey

[11] 4,400,965

[45] Aug. 30, 1983

[54] FORMING INTEGRAL FLANGES IN A SHEET APPARATUS THEREFORE

[75] Inventor: John A. Schey, Waterloo, Canada

[73] Assignee: Modine Manufacturing Company, Racine, Wis.

[21] Appl. No.: 409,702

[22] Filed: Aug. 18, 1982

Related U.S. Application Data

[62] Division of Ser. No. 134,513, Mar. 27, 1980, Pat. No. 4,373,369.

[51] Int. Cl.[3] ..... B21D 22/00

[52] U.S. Cl. ..... 72/334; 72/347; 72/354; 72/356; 29/157.3 C

[58] Field of Search ..... 72/329, 326, 330, 334, 72/352, 354, 356, 327, 331, 333, 338, 347; 428/512; 29/157.3 R, 157.3 C

[56] References Cited

U.S. PATENT DOCUMENTS

| | | | |
|---|---|---|---|
| 204,716 | 6/1878 | Delkescamp | 72/334 |
| 638,808 | 12/1893 | Holinger | 72/355 |
| 1,048,046 | 12/1912 | Currey | 73/334 |
| 1,699,361 | 1/1929 | Karmazin | 72/334 |
| 2,308,953 | 1/1943 | Brown | 72/327 |
| 2,438,837 | 3/1948 | Archer et al. | 72/313 |
| 2,679,931 | 6/1954 | Cigliano | 72/255 |
| 2,859,510 | 11/1958 | Baxa . | |
| 2,898,788 | 8/1959 | Baxa . | |
| 2,909,281 | 10/1959 | Koskinen | 72/347 |
| 3,064,507 | 11/1962 | Strugala . | |
| 3,080,839 | 3/1963 | Fein et al. . | |
| 3,245,465 | 4/1966 | Young . | |
| 3,303,806 | 2/1967 | Whiteford . | |
| 3,412,593 | 11/1968 | Price | 72/335 |
| 3,625,170 | 12/1971 | Josok | 72/334 |
| 3,757,718 | 9/1973 | Johnson | 72/354 |
| 4,150,556 | 4/1979 | Melnyk | 72/333 |
| 4,168,619 | 9/1979 | Moose | 72/334 |

*Primary Examiner*—Leon Gilden

*Attorney, Agent, or Firm*—Wood, Dalton, Phillips, Mason & Rowe

[57] ABSTRACT

The method and apparatus for forming flanged holes and a resulting plate and tube assembly of the type used in fluid-to-fluid, such as gas-to-gas, liquid-to-liquid and liquid-to-gas, heat exchangers. A depression is formed with the aid of a punch in a plastically deformable metal sheet such as steel, aluminum, copper and the like, while applying controlled counterpressure with the aid of a larger counter-punch so that material displaced from the space between the punches is laid upon the inner bore of a constraining die. Thus the wall of the depression is formed by purely compressive means. The base of the depression may then be removed to provide deep flanges of controlled dimensions free of cracks or splits.

4 Claims, 10 Drawing Figures

FORMING INTEGRAL FLANGES IN A SHEET APPARATUS THEREFORE

This is a division of application Ser. No. 134,513 filed Mar. 27, 1980, now U.S. Pat. No. 4,373,369.

BACKGROUND OF THE INVENTION

In the customary way of producing flanges surrounding openings in deformable metal sheets for the purpose of strengthening the opening or preparing it to receive a tube, as in header assembles used for such applications as heat exchangers, it is customary first to pierce or perforate the sheet and then displace the portions of the sheet surrounding these holes from the plane of the sheet to form the flange. Such procedure is exemplified in prior U.S. Pat. Nos. 3,425,465 and 4,150,556. It has been found that when the hole is formed as by cutting out sections of the sheet or header plate and then deforming the sheet around the hole to form the flange, the edges of the sheet at the flange edge frequently split owing to the circumferential tensile deformation, so that it is not only difficult to form a joint with another piece of metal such as a tube soldered, welded or the like in the hole but, even when the joints are made, the splits are a major source of leakage. Furthermore, flange walls formed in this manner are of limited height, are often not parallel and their height tends to be uneven. In addition, their wall thickness gradually diminishes towards the edges. These features not only create further difficulties in tube-and-header assemblies but weaken the structure for other purposes as well.

Several methods have been suggested to overcome these difficulties. Thus, more material may be made available by drawing in material adjacent to the site of a flange by first creating a dimple, sometimes by reverse dimpling as in prior U.S. Pat. Nos. 1,699,361 and 3,412,593. The thickness of the flange may be made uniform by upsetting the formed flange in a separate operation, as in prior U.S. Pat. No. 2,859,510. More material may be made available for a thicker flange by compressing the sheet between two punches of equal size with a cross-sectional area equal to the inner dimensions of the future hole, as in prior U.S. Pat. No. 2,909,281.

Cracking of the flange edge can be delayed or prevented by a number of means. Removing the burr produced in punching out the hole is well known to increase the allowable diameter expansion in flanging. Further improvements can be achieved by extruding the flange after the hole has been deburred as in prior U.S. Pat. No. 3,412,593. Yet another solution is described by M. H. Williams in SAE paper No. 780,393 as a process sequence in which the hole is first pierced as in traditional flanging and then the flange formed by drawing between a punch and a back-up tool which maintains a compressive stress on the flange edge. This delays splitting and allows much deeper flanges to be formed. By the nature of the flanging process, the wall thickness of the flange still diminishes towards its edge. A parallel wall of uniform thickness can then be obtained, if so desired, in a subsequent ironing step. A total of 3 steps are thus required, and deformations attainable in the second and third steps are limited by both material and process limitations.

SUMMARY OF THE INVENTION

One of the features of the present invention is to provide a method for making an integral flange around an opening in a plastically deformable metal sheet. In this method a depression or dimple is first formed in the metal sheet by exerting localized pressure on one side of the sheet over an area equal to the internal cross-sectional area of the depression while simultaneously applying an opposing deformation pressure over an area equal to the external cross-sectional area of the depression. Material between the two opposing die elements is displaced to form a depression of the desired depth corresponding to the desired height of the flange. The depression thereupon has a straight, parallel-sided side wall and an integral base in the portion of the metal sheet between the pressure means and the counterpressure means. To complete a flange with an open end this base is then severed from the side wall to provide the hole with the surrounding flange.

This method, product and apparatus for practicing the method, which are all the subject of the accompanying claims, have a number of advantages over previous methods of making flanged holes. Splits in the edges of the flange surrounding the openings are avoided by assuring that the material is always in compression during the formation of the depression. The walls of the resulting flange are of uniform thickness, parallel to each other, of uniform height and of controlled dimensions. Where a joint is later produced by welding, brazing, soldering and the like, this joint is much less prone to failure.

DESCRIPTION OF THE PREFERRED EMBODIMENTS

Figure 1:
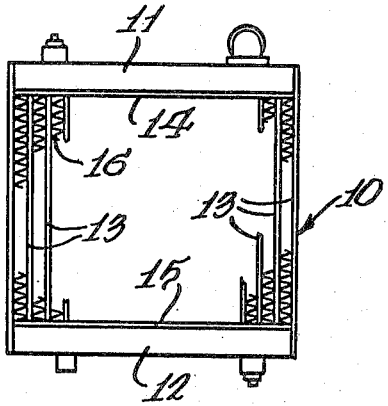
FIG. 1 is a front elevational view of an automotive radiator of the tank-and-tube type embodying the invention.

One application of the present invention is illustrated by a radiator in FIG. 1. The radiator 10 comprises an upper tank 11, a lower tank 12 spaced therefrom and interconnecting tubes 13 extending between upper and lower plastically deformable metal sheets 14 and 15 that comprise the header plates. The tubes 13 are substantially parallel and are spaced apart and connected in the customary manner by serpentine heat conducting fins 16.

Figure 2:
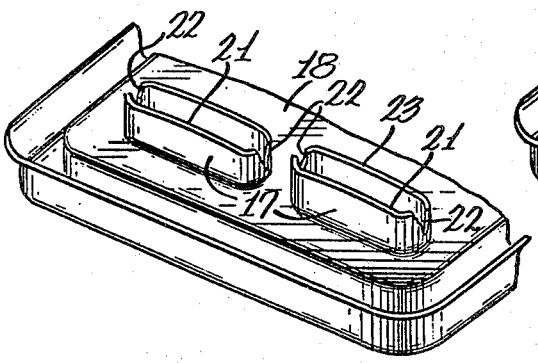
Fig. 2. (PRIOR ART)
FIG. 2 is a fragmentary perspective view of a portion of a header plate and a pair of flanges illustrating the prior art.

In the customary way of making this connecting flange 17 integral with the header plate 18, as illustrated in FIG. 2, the plate 18 is perforated to make the hole 21, then the plate portions are deformed outwardly to form the flanges surrounding these holes. When this procedure is followed it is found that a high portion, in some instances approaching 100%, of the flanges develop splits in the edge. These splits are illustrated in FIG. 1 at 22 and, as can be noted, start at the flange edge and penetrate almost to the plate 18.

Figure 3:
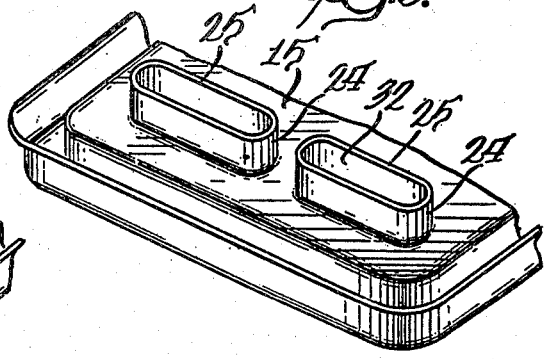
FIG. 3 is a view similar to FIG. 2 but illustrating flanges produced according to the present invention.

In contrast, FIG. 3 illustrates a plate with flanged holes produced according to this invention. As can be noted there, the metal sheet or header plate 15, which is similar to the upper plate 14, contains flanges 24 that have smooth edges 25 completely free of splits. These edges, if desired, can lie in a plane that is parallel to the remainder of the sheet 15.

Figure 7:
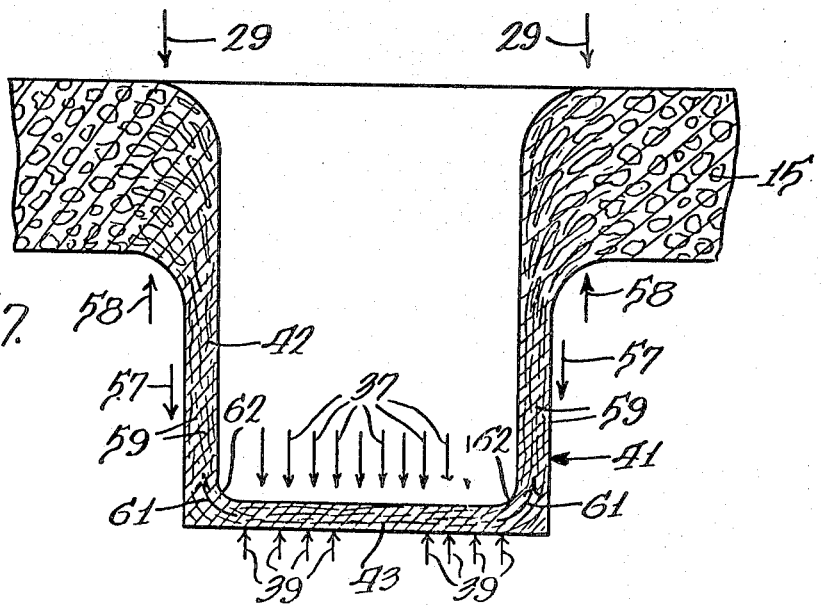
FIG. 7 is an enlarged fragmentary sectional view through the formed depression and the surrounding portion of the plate illustrating the stresses that are set up, with this sectional view being taken through a depression substantially along line 7—7 of FIG. 6.
Figure 4:
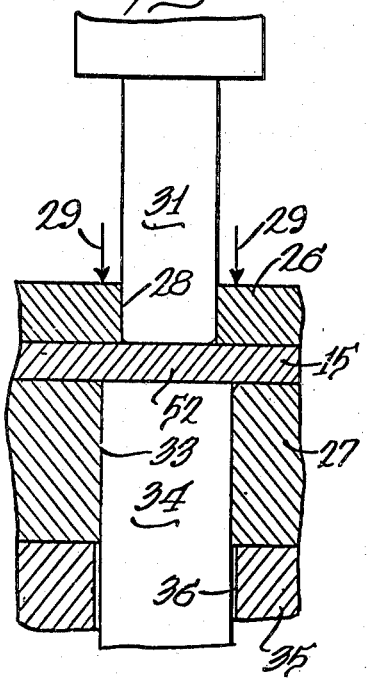
FIG. 4 is a fragmentary, semi-schematic, vertical sectional view through an apparatus for practicing the method of this invention producing the product thereof and showing the first stage of the method.
Figure 5:
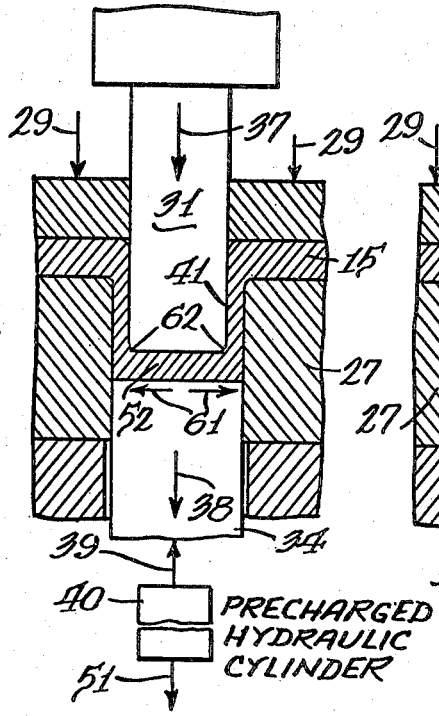
FIGS. 5 and 6 illustrate successive steps in the practice of the method of this invention.
Figure 6:
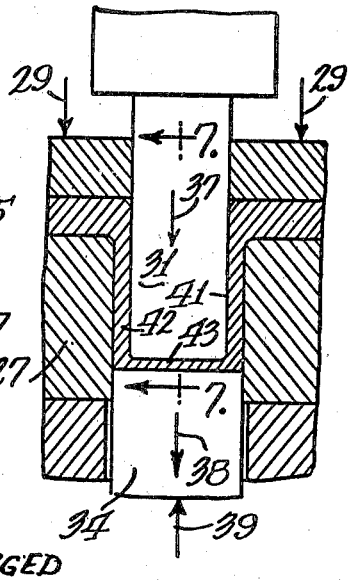

The steps in forming a flange 24 are illustrated in FIGS. 4–6 with the flange itself being illustrated in FIG. 7.

The metal sheet which is plastically deformable is illustrated in the successive figures of the illustrated embodiment at 15. This sheet is clamped between a pressure plate or blank holder 26 and a die 27, with the pressure plate 26 having a cut-out opening 28 in which is received and vertically movable a punch 31 having a cross-sectional area in dimensions substantially equal to the corresponding internal dimensions 32 (FIG. 3) of the resulting flange 24.

Located in a similar cut-out opening 33 in the die 27 and substantially concentric with the punch 31 is a counterpunch 34. This counterpunch 34 is slidable in the opening 33 so that the opening and counterpunch have substantially the same crosssectional area which is substantially the same as the outer dimensions of the flange 24.

The die 27 is supported by a backup plate 35. This plate 35 has an opening 36 which is slightly larger than the opening 33 and in which the counterpunch 34 is retractable.

While the sheet or plate illustrated at 15 is clamped between the pressure plate 26 and die 27 as illustrated by the arrows 29 of FIGS. 4–7 in the region surrounding the punch 31, the punch 31 is moved under a pressure as illustrated by the arrow 37 in FIGS. 5, 6, 8 and 9, while this pressure of the punch is resisted by a counterpressure 39 of the counterpunch 34 on the opposite side of the sheet 15. Thus, while the punch 31 is moved in its pressure direction 37 the counterpunch 34 resists this pressure while moving in the direction 38 on the opposite side of the sheet.

As illustrated schematically in FIG. 5, the counterpressure 39 may be provided by a hydraulic cylinder which is precharged to the requisite pressure. In the course of the downward movement of punch 31, hydraulic fluid is allowed to escape from this hydraulic cylinder as indicated at 51 at such preset pressure to maintain the desired counterpunch force. The material between punch 31 and counterpunch 34 is thus forced to deform plastically, and the side walls 42 of the depression or dimple 41 (the future flange 24) are formed. Because deformation occurs by compressive stresses, fracture is prevented and flanges can be formed even with materials of relatively modest ductility.

Figure 8:
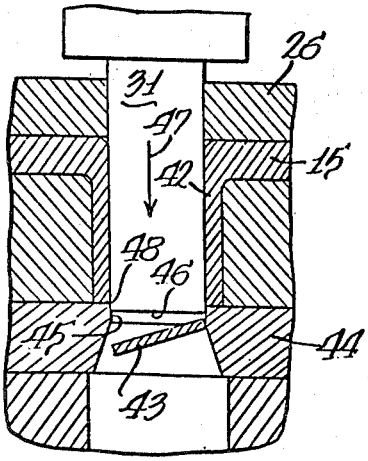
FIGS. 8–10 illustrate different embodiments of severing the base from the side wall of a depression to form a flange.
Figure 9:
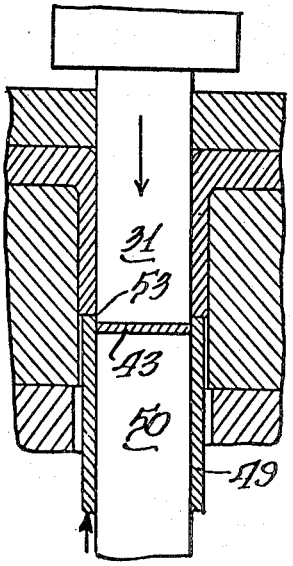

As is illustrated in FIGS. 6, 8 and 9 this pressure 37 and counterpressure 39 are maintained to form a depression 41 in the sheet between each punch 31 and counterpunch 34, while radially displacing material 52 (FIG. 5) from the space between punch 31 and counterpunch 34. This displaced material forms the side walls 42 of the depression.

When the depression 41 has reached a desired vertical dimension in FIG. 6 the dimple thus formed comprises a side wall 42 and an integral base 43.

After the conclusion of the formation of the depressions 41 the base 43 may be severed from the side wall to produce each flange as illustrated by the flanges 24 in FIG. 3. One embodiment of the severing operation is illustrated in FIG. 8. Herethe punch 31 and pressure plate 26 are retracted, the workpiece comprising the plate 15 and depression 41 is lifted by the counterpunch 34, and transferred by customary means to the next die station of FIG. 8 at which the back up plate 35 is replaced by a die plate 44 containing a cutting edge 45. This cutting edge 45 is of substantially the same area as the pressure end 46 of the punch 31. The punch 31 is then again moved downwardly as illustrated by the arrow 47 so that the cooperating action of the sharp punch edge 48 and the cutting edge 45 of the die 44 severs the integral base 43 to leave the edge 25 (FIG. 3) of the flange 24 of this invention.

Another embodiment of a method and apparatus for severing the integral base 43 is illustrated in FIG. 9. Here the counterpunch is composed of two parts. The inner part 50 has substantially the same outer dimensions as those of the punch 31 and is movable within and relative to an outer tubular shell 49. In the course of forming the depression the two parts 50 and 49 are forced to move together. When the desired depth of the side wall 42 is reached, the outer tube 39 is arrested and its upper edge 53 shears the base 43 in cooperation with the bottom 46 of the punch 31 as illustrated.

Figure 10:
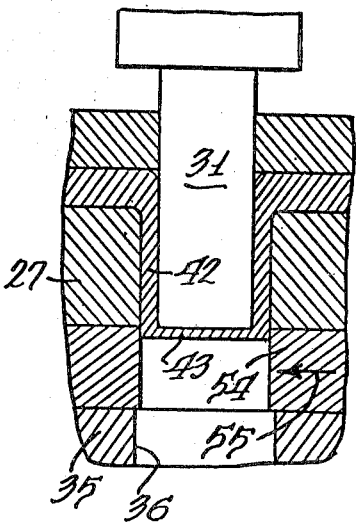

FIG. 10 illustrates still another method and apparatus for severing the integral base 43. In this embodiment the depression 41 is formed to its full depth, then the counterpunch 34 is retracted from the back up plate 35 opening 36 and the base 43 is sheared from the side wall 42 by shear plate 54 being forced in a cross direction 55 between the die 27 and the back up plate 35. During this shearing the punch 31 is held stationary and the counterpunch 34 is completely retracted. The shear plate 54 may be incorporated into a separate die station or it may form the lower part of die 27.

In the method and apparatus of this invention and in the resulting product substantially all the metal required for depression 41 is formed from metal 56 of the sheet or plate 15 in FIG. 4, this metal 56 being located between the cooperating ends of punch 31 and counterpunch 34. Thus, in the course of depression formation, illustrated in FIGS. 5 and 6, the side wall 42 of the depression remains at substantially the same thickness but the thickness of the base 43 continually decreases, as can be seen by a comparison of 52 in FIG. 5 and 43 in FIG. 6.

The metal structure around and in each depression 41 is illustrated in FIG. 7. In the course of radially 61 displacing material from the base 43 of the depression 41, the plate or sheet 15 surrounding the punch and counterpunch is held against substantial movement by the forces 29 acting on the pressure plate 26. The side wall 42 of the depression is therefore formed by the radial 61 (lateral) displacement of metal from between the punch 31 and counterpunch 34; thus the grains of the metal become oriented and, in metals in which flow lines can be developed by known techniques, the flow lines show uninterrupted material flow around the corner 62 of the punch 31.

The side wall 42 develops in full contact with the side surfaces of the punch 31 and the cut-out opening 33 of die 27. Because the side wall 42 is being laid upon the opening 33 as it is being formed, there is no relative movement between cut-out opening 33 and the depression wall 42 and the process does not suffer from the harmful effects of friction on this surface. It is therefore permissible to exert on punch 31 and counterpunch 34 all the pressure required for forming the depression 41 and, in contrast to other processes such as described in prior U.S. Pat. No. 3,757,718, no tension is imposed on the material of the wall 42. Also, because of laying the wall 42 during its formation onto the cut-out opening 33, friction reaction is minimized or eliminated and there is no need for the plate 15 to rise as is required as in prior U.S. Pat. No. 2,909,281. Furthermore,no separation between wall 42 and cut-out opening 33 is necessary in contrast to prior U.S. Pat. No. 3,303,806.

Application of a lubricant, which is well known in the metal working art, is desirable to facilitate lifting of the depression 41 from the die 27 and also for reducing die wear. The punch 31 is in frictional sliding contact with the inner surface of the depression and is preferably lubricated. A lubricant is desirable also for reducing the pressure needed for radially displacing material from between punch 31 and counterpunch 34. Such lubrication does not interfere with the laying on of the developing depression wall 42 onto the die 27 cut-out 33 and does not change the material flow characteristic of this process.

In the method and apparatus of this invention the punch 31 is moved at a faster rate than the rate of the counterpunch 34 retraction 38. In general, the ratio of punch 31 velocity to counterpunch velocity 38 is approximately equal to the ratio of cross-sectional counterpunch 34 area to the crosssectional punch area 31, while sufficient pressure is maintained between punch and counterpunch to assure plastic flow in the material of base 43.

As can be noted in FIG. 3, each flange 24 produced according to this invention may be not only cylindrical but oval or any other shape. The edge 25 of each flange is in a plane that is substantially parallel to the plane of the sheet 15 surrounding the flange. In the apparatus the difference in crosssectional area between the punch 31 and the counterpunch 34 determines the thickness of the side wall 42 of the depression 41 that comprises the flange.

In the present invention each flange is formed to its finished dimensions in a single operation and it is not until the side wall comprising the flange is completely formed that the base is severed from the side wall to provide the hole. Thus the hole is punched only after the flange has been fully formed. This not only avoids split edges but also results in preselected exact dimensions.

Furthermore, if desired, the entire base 43 may be retained or only a portion of the base may be severed depending upon the desired structure of the resulting product. The present invention, therefore, provides an improved structural flange of uniform height with a planar edge, where such is desired. The flange is free of cracks, free of substantial springback, and with walls that are parallel to each other around the entire circumference of the flange. This flange may have a preselected shape and dimensions dependent upon the shape and dimensions of the punch and counterpunch, and the flange will be produced with uniform and precisely controlled wall thickness from the root at the plate to the outer edge. Therefore, there is no need for a separate operation such as is disclosed in prior U.S. Pat. No. 2,859,510.

Because deformation 59 of the metal forming the side walls 42 of the depressions 41 shown in FIG. 7 occurs as a result of compressive forces between the punch and counterpunch, fracture of the side walls is materially prevented and even plate materials having low ductility can be shaped to provide flanges without difficulty. The pressure required for forming the depressions or dimples is a function of the flow stress of the material and of friction at the various contact surfaces.

Having described my invention as related to the embodiments shown in the accompanying drawings, it is my intention that the invention be not limited by any of the details of description, unless otherwise specified, but rather be construed broadly within its spirit and scope as set out in the appended claims.

I claim:

1. An apparatus for forming a plate structure including an integral depression, comprising: clamp means for clamping said plate except at an area corresponding to the location of said depression; a punch engaging one side of said plate at said depression area; a counterpunch on the other side of said plate opposite to said punch and having a cross-sectional area greater than the area of said punch, the difference in extent of said area defining the thickness of the side walls of said depression, said punch and counterpunch being movable in the same direction but at different rates, said counterpunch supported by resistive means to create sufficient pressure in said area of said plate to cause metal displaced from the area between said punch and counterpunch to be laid upon the internal surface of a confining die in which said counterpunch is slidably mounted, to produce a depression in said plate having heavily deformed walls and a base thinner than said plate.

2. An apparatus according to claim 1 wherein means are provided for severing the base of said depression to produce a flange.

3. The apparatus of claim 1 wherein means are provided for clamping said sheet tightly against movement around said intended depression during said deforming with the result that substantially all of the material in said side wall and base of said depression is from said area of said sheet, and wherein said localized pressure is produced by a pressure punch having an end engaging the sheet material and of an area substantially equal to the internal dimensions of the said depression and said counterpressure is produced by a yielding counterpunch on the opposite side of said sheet having lateral dimensions substantially equal to the outside dimensions of said sheet depression while said side wall is confined in a die of substantially the same lateral dimensions as said counterpunch.

4. The apparatus of claim 3 wherein said punch and counterpunch are moved with relation to said sheet at different velocities with the ratio of punch velocity to lesser counterpunch velocity being proportional to the ratio of the cross-sectional area of the counterpunch to the cross-sectional area of the punch.

* * * * *

UNITED STATES PATENT AND TRADEMARK OFFICE

CERTIFICATE OF CORRECTION

PATENT NO. : 4,400,965

DATED : August 30, 1983

INVENTOR(S) : JOHN A. SCHEY

It is certified that error appears in the above-identified patent and that said Letters Patent is hereby corrected as shown below:

The title should be amended to read "Forming Integral Flanges in a Sheet and Apparatus Therefor".

Signed and Sealed this

*Fourteenth* Day of *February 1984*

[SEAL]

*Attest:*

GERALD J. MOSSINGHOFF

*Attesting Officer*

*Commissioner of Patents and Trademarks*